US005588940A

United States Patent [19]

Price et al.

[11] Patent Number: 5,588,940

[45] Date of Patent: Dec. 31, 1996

[54] WEIGHT SUPPORTING BODY HARNESS

[76] Inventors: Eric M. Price; Aaron R. Price, both of 63 Cambridge Dr., Short Hills, N.J. 07078

[21] Appl. No.: 489,392

[22] Filed: Jun. 12, 1995

[51] Int. Cl.[6] ..... A63B 21/065

[52] U.S. Cl. ..... 482/105; 482/99; 482/139; 482/93; 224/259

[58] Field of Search ..... 482/92, 93, 98, 482/99, 105, 139, 122–124, 148; 224/257–260, 264; 280/290

[56] References Cited

U.S. PATENT DOCUMENTS

| | | | |
|---|---|---|---|
| 223,799 | 1/1880 | Butler | 482/139 |
| 635,683 | 10/1899 | Herman | 280/290 |
| 882,181 | 3/1908 | Thomas | 482/139 |
| 892,991 | 7/1908 | Hepworth | 224/259 |
| 2,441,115 | 5/1948 | Lambert | 224/259 |
| 2,996,228 | 8/1961 | Bauman | 224/259 |
| 3,322,425 | 5/1967 | Moore . | |
| 3,370,850 | 2/1968 | Moore . | |
| 3,751,031 | 8/1973 | Yamauchi . | |
| 4,125,211 | 11/1978 | Handsman | 224/259 |
| 4,589,658 | 5/1986 | Gibson . | |
| 4,948,122 | 8/1990 | Andrews . | |
| 4,984,786 | 1/1991 | Lemke . | |
| 5,167,600 | 12/1992 | Baird . | |

FOREIGN PATENT DOCUMENTS

| | | | |
|---|---|---|---|
| 2492264 | 4/1982 | France . | |
| 0667935 | 11/1988 | Switzerland | 224/259 |
| 1489787 | 6/1989 | U.S.S.R. . | |

*Primary Examiner*—Richard J. Apley
*Assistant Examiner*—Victor K. Hwang
*Attorney, Agent, or Firm*—Jones, Tullar & Cooper, P.C.

[57] ABSTRACT

A weight supporting body harness is used to support additional weight between the legs of a weight trainer. The body harness includes a torso engaging webbing assembly that directly supports the additional weights, and a waist encircling strap that stabilizes the torso engaging webbing. The weight supporting body harness allows the weight trainer to effectively increase his body weight while lowering his effective center of gravity.

4 Claims, 4 Drawing Sheets

WEIGHT SUPPORTING BODY HARNESS

FIELD OF THE INVENTION

The present invention is directed generally to a weight supporting body harness. More particularly, the present invention is directed toward a weight supporting body harness for use in performing exercises that utilize a weight-trainer's bodyweight as a source of resistance. More specifically, the present invention is directed to a weight supporting body harness which is securable about a user's body and which allows the user to increase his effective bodyweight by the attachment of additional weight to the harness. Once the user has put on the harness and attached those additional weights, various exercises can be performed. Since the user's effective bodyweight can be increased by attachment of additional weight to the harness, the desired natural progression of increased resistance in proportion to increased strength can be achieved.

DESCRIPTION OF THE PRIOR ART

Exercises that utilize the weight-trainer's own bodyweight as the source of resistance are some of the most effective weight-training exercises. Three exercises of this category are pull-ups, chin-ups, and dips. These, and other similar exercises are most often performed without machines or weights; they require only a straight bar suspended overhead for pull-ups and chin-ups, and waist high parallel bars for dips. The bodyweight of the weight-trainer serves as the only source of resistance.

After a weight trainer has performed these exercises for an extended period of time, his bodyweight becomes inadequate to fully train the target muscles. In essence, the muscles respond to the shock of training by growing. For further growth, trainers must either increase the number of repetitions or sets they perform, or must increase the weight with which the exercise is performed. For most exercises, the choice would be to increase weight and thus resistance, but since the lifter's bodyweight is the only source of resistance, increasing resistance seems impossible.

Increasing the number of repetitions or sets performed is not a good alternative for most trainers, for these increases take time and energy and are not particularly efficient. In addition, increasing the number of repetitions or sets performed is not an effective way for many trainers to achieve their goals. Many weight lifters train to increase their muscle mass. Only by increasing resistance; i.e. weight being lifted, can a noticeable increase in mass result.

Many trainers realize the benefits as well as the limitations associated with bodyweight resistance exercises. Accordingly, many prior art attempts have been made to provide a way to allow trainers to overcome the limits of their own bodyweight. One such prior art attempt is a shoulder harness. The shoulder harness allows the wearer to "add" weight to his body in a fashion similar to that in which a knapsack allows the wearer to carry books or the like. When using these shoulder harnesses to increase bodyweight resistance by a small weight increment, for example, ten pounds, such devices are effective and safe. When these prior art shoulder harnesses are used to increase bodyweight resistance by larger weight increments, for example, by up to forty pounds or more, which is not uncommon, the safety of the trainer is at risk. This is because a shoulder harness that allows the user to attach weights to the body increases the height of the user's center of gravity.

The danger of the change in center of gravity location can be readily seen by thinking in terms of simple physics. The trainer can be thought of as a lever system, a weight located at a particular distance from a fulcrum. Assuming the trainer is standing upright, the fulcrum is the trainer's feet, the weight is the trainer's body weight, and the distance from the weight to the fulcrum is the distance between the trainer's center of gravity and the ground. This system has a particular torque associated with it. Torque is the product of the distance from the weight to the fulcrum, called the lever arm, and the weight, which is concentrated at the trainer's center of gravity. The torque of a system directly affects the tendency for that lever to swing on its fulcrum. In this system, swinging on the fulcrum would be analogous to the trainer losing balance or toppling over. Most people rarely worry about losing balance and toppling over, because they are accustomed to maneuvering within the parameters of their particular body's center of gravity and its associated lever arm. Since shoulder harnesses increase the height of the user's center of gravity, and hence the lever arm, and also increase the weight, the torque of the system increases multifold, thus increasing the tendency for that system to swing. This translates into a situation where a trainer is in danger of toppling over because he or she has to maneuver a system with a torque that he or she is wholly unaccustomed to, thus making that trainer vulnerable to losing balance and/or toppling over.

This concept is more easily understood when thinking in terms of wearing a hiking style backpack. A loaded pack weighs from forty to eighty pounds. Anyone who has ever worn a loaded pack and tried to tie their shoe or duck under a low hanging branch has experienced a scary loss of balance and felt a toppling-over sensation. These phenomena occur because of the increased load borne by the hiker and the increased height of his center of gravity. It is understood that one does not attempt deft maneuvers while wearing a weight training harness, however the same dangers of loss of balance and toppling over exist. In addition, when a trainer finishes an intense exercise, that trainer is fatigued. Fatigue lessens the amount of fine control that the trainer has over his or her muscles and could easily result in loss of balance and toppling over. This intrinsic flaw endangers not only the user, but nearby trainers who would suffer severe injury if the user were to fall and interrupt an exercise in progress or even fall on another trainer.

Several prior art patents show or suggest arrangements of shoulder harnesses. They are French patent number 2 492 264 to Balalud, Soviet Union patent number 1489787 to Berdachev, U.S. Pat. Nos. 3,322,425 and 3,370,850 to Moore, U.S. Pat. No. 4,948,122 to Andrews, Sr., and U.S. Pat. No. 5,167,600 to Baird.

Other devices that have been designed to accomplish the task of increasing the bodyweight resistance of the user do so in such a way that the extra weight is suspended from and supported by the hips. This approach is extremely dangerous, however its effects are not immediate. When suspending weight from the hips, all load is effectively placed on the pelvic girdle. In so doing, the spinal column is endangered. The spine attaches directly to the pelvic girdle, so any load borne by the hips causes the spine to be pulled and stretched. By repeatedly doing this over the long period of time required for muscular growth and response, the spinal column irreversibly adapts by stretching. This stretching will increase the distance between the individual vertebrae that compose the spinal column, rendering the user highly vulnerable to suffering a slipped disc and/or a pinching of the spinal nerve. The result may be extreme pain and possible paralysis.

U.S. Pat. No. 3,751,031 to Yamauchi; U.S. Pat. No. 4,589,658 to Gibson; and U.S. Pat. No. 4,984,786 to Lemke et al., are all based on harnesses that suspend weight from the hips.

It should be noted that a common form of torture during the Spanish Inquisition was to suspend weight from the legs of victims while the victims were suspended by their arms in midair. The victims were then left alone, and over time the area comprising the joints of the victims would increase and the body would elongate. When the victims were released from their suspension they would collapse and usually die.

It will be apparent that a need exists for a weight suspension device which will overcome the limitation of the prior art devices. The weight supporting body harness of the present invention provides such a device and is a significant improvement over the prior art devices.

SUMMARY OF THE INVENTION

It is an object of the present invention to provide a weight supporting body harness.

Another object of the invention is to provide a weight supporting body harness usable by a weight-trainer.

A further object of the present invention is to provide a weight supporting body harness which is worn on the torso of the user.

Yet another object of the present invention is to provide a weight supporting body harness which is attached to the user's torso and supports weights placed on the harness between the user's legs.

Still a further object of the present invention is to provide a weight supporting body harness which is effective and which is also safe.

As will be discussed in detail in the description of the preferred embodiment which is set forth subsequently, the weight supporting harness in accordance with the present invention includes a torso engaging webbing assembly that utilizes a pair of shoulder engaging suspender straps which are connected at their lower ends to a waist encircling belt. The waist belt and suspender straps join at a front hoop which generally overlies the wearer's naval. An S-hook is attached to the rear of the waist belt and to the rear portion on the suspender straps generally at the point of convergence of the rear ends of the suspender straps. This front hoop and rear S-hook serve as attachment points for a weight supporting chain or strap. The chain or strap can be fed through the central opening in conventional weight plates so that these weight plates can be suspended from the weight supporting body harness generally between the legs of the harness wearer.

The weight supporting body harness of the present invention is a significant improvement over the prior art shoulder harnesses and devices that place load on the hips. The present device provides a system for increasing effective bodyweight that places the load on the shoulders of the user without increasing the height of the user's center of gravity, but instead lowering it. One advantage of this invention is that the user will not experience a loss of balance when using the weight supporting body harness. This not only protects the user, but other trainers as well, for if the user falls in the path of another trainer, that trainer could also be injured.

Another advantage of this invention is that the user will not endanger his or her spinal chord in order to increase effective bodyweight. The present device supports the additional weight from the harness wearer's shoulders, not from his hips.

Further advantages are derived by the weight trainer from the use of this invention. The user will find this weight supporting body harness to be convenient and easy to use. The user will also find this weight supporting body harness to be portable and within his or her budget. Since the weight supporting body harness is compatible with conventional standard and olympic weights, the user will not have to acquire a distinct type of weight intended only for use with this weight supporting body harness.

The weight supporting body harness of the present invention was built not only with particular exercises in mind, but was built with the idea that these exercises are done within the context of an exercise routine. It was built by a weight-trainer for weight trainers. Since it is both portable and affordable, individual trainers can purchase it instead of having to rely on a gym to which they belong to possess one. Accordingly, each user does not have to take time to adjust the weight supporting body harness according to his or her particular dimensions each time he uses it. Thus the flow of the individual training session will not be interrupted and the weight trainer's efficiency will be maintained. Time between sets normally spent recuperating and mentally preparing for the forthcoming set will not have to be spent adjusting a weight supporting body harness. In addition, the weight supporting body harness in accordance with the present invention is not so complex that help is necessary when putting on and taking off the weight supporting body harness, thus allowing the trainer to train alone if desired.

The weight supporting body harness of the present invention overcomes the limitations of the prior art weight suspension devices presently available. The weight supporting body harness can be used to increase the bodyweight resistance of a trainer easily and conveniently and can be used with standard or olympic type weights. In addition, it can be reasonably purchased by the individual trainer, is compact and easy to store, and is easy to bring along when traveling away from home. Further, it is safe and effective and does not endanger the user or nearby trainers. The weight supporting body harness of the present invention is a significant advance in the art.

BRIEF DESCRIPTION OF THE DRAWINGS

While the novel features of the weight supporting body harness of the present invention are set forth with particularity in the appended claims, a full and complete understanding of the invention may be had by referring to the detailed description of the preferred embodiment which is presented subsequently, and as illustrated it the accompanying drawings, in which:

DESCRIPTION OF THE PREFERRED EMBODIMENT

Figure 1:
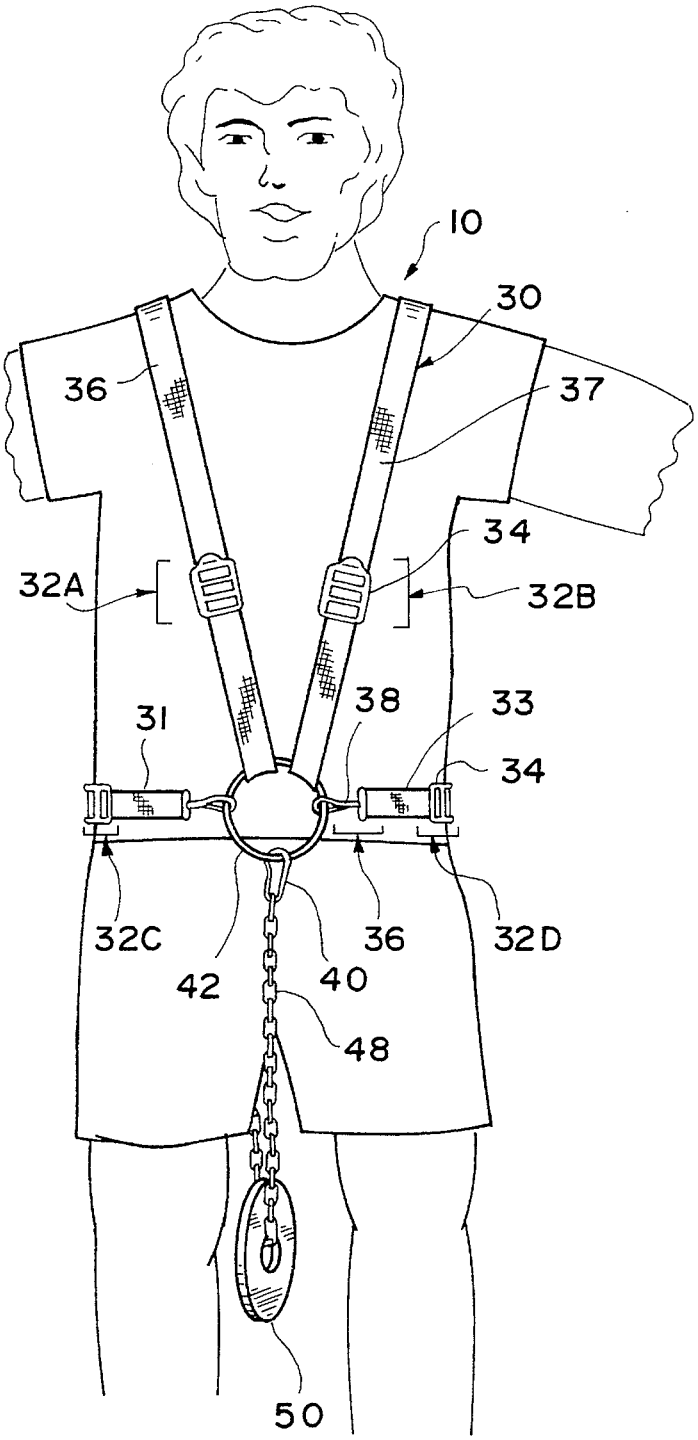
FIG. 1 is a front elevational view showing the weight supporting body harness in accordance with the present invention being worn by the user.
Figure 2:
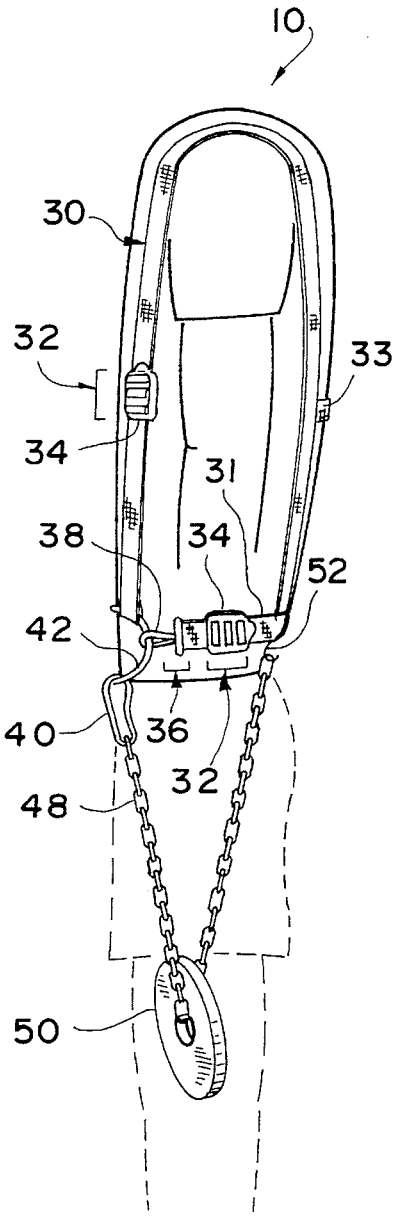
FIG. 2 is a side elevation view of the weight supporting body harness of FIG. 1 worn by the user.
Figure 3:
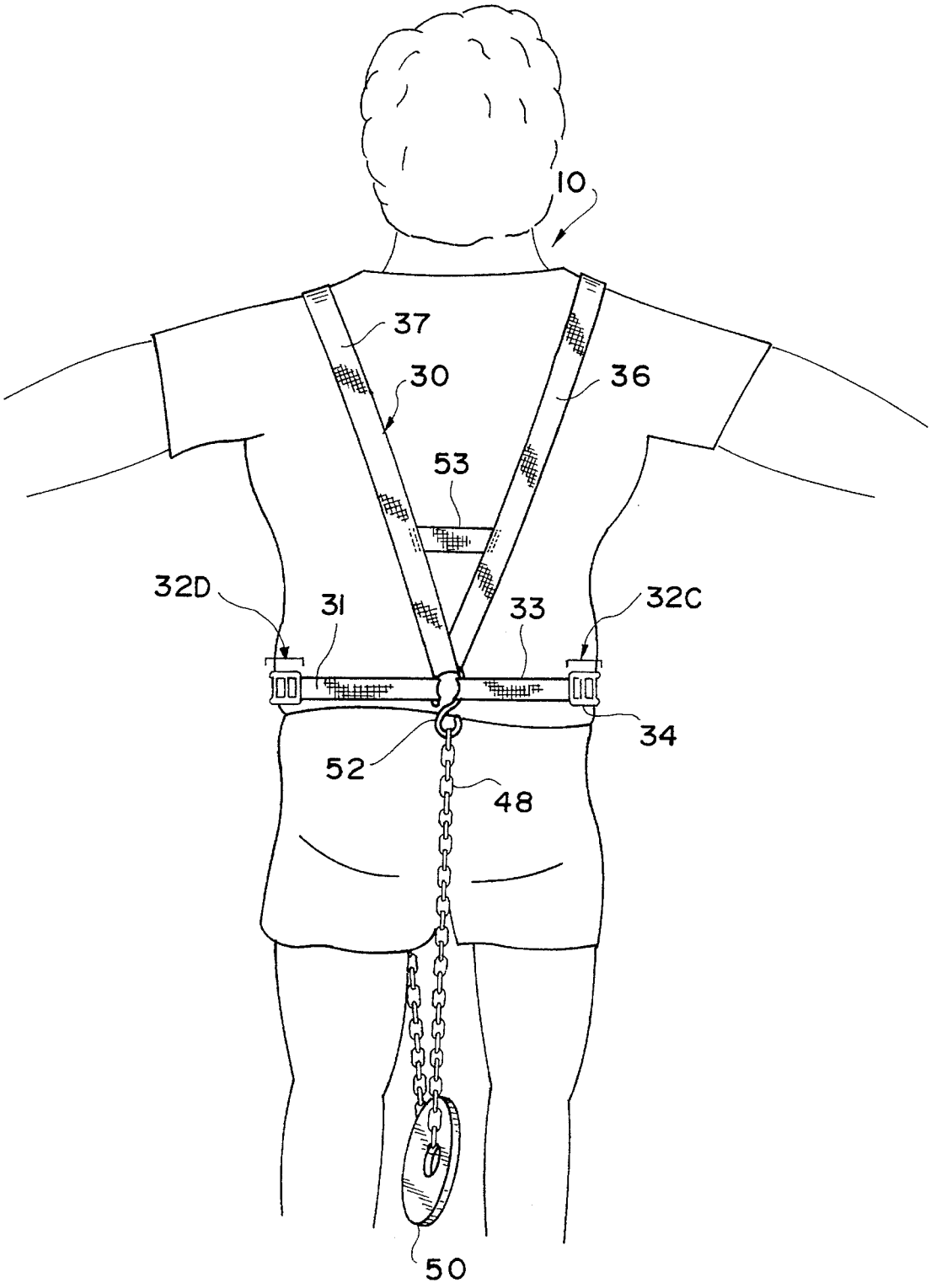
FIG. 3 is a rear elevation view of the weight supporting body harness of FIG. 1 as worn by the user.

The preferred embodiment of a weight supporting body harness in accordance with the present invention is illustrated generally at 10 in FIG. 1, FIG. 2, and FIG. 3. The weight supporting body harness 10 consists of a torso engaging webbing assembly generally at 30 and a waist encircling webbing 31. A front hoop 42 and a rear S-hook 52 are used to join the torso engaging webbing assembly 30 to the waist encircling webbing 31. Front hoop 42 rests in the front of the user at the height of the user's waistline and S-hook 52 rests in the back of the user, also at the height of the user's waistline. Front hoop 42 is shown in detail in FIG. 4. S-hook 52 is detailed in FIG. 5. The weight supporting body harness in accordance with the present invention can be divided into upper, middle, and lower thirds to facilitate easy discussion and explanation.

Figure 4:
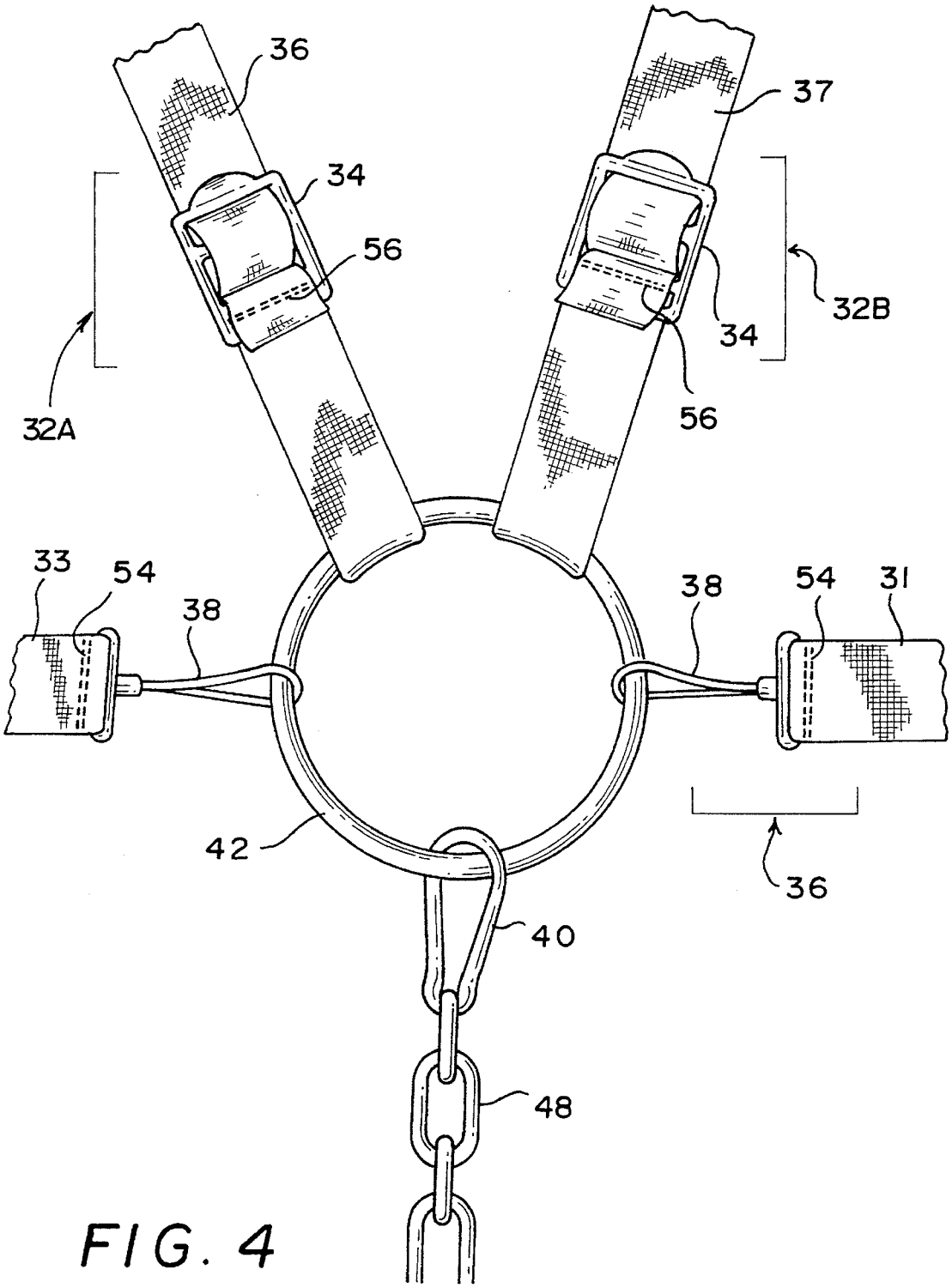
FIG. 4 is a partial front elevation view enlarged to show the various connections that help in securing the weight supporting body harness on the user.
Figure 5:
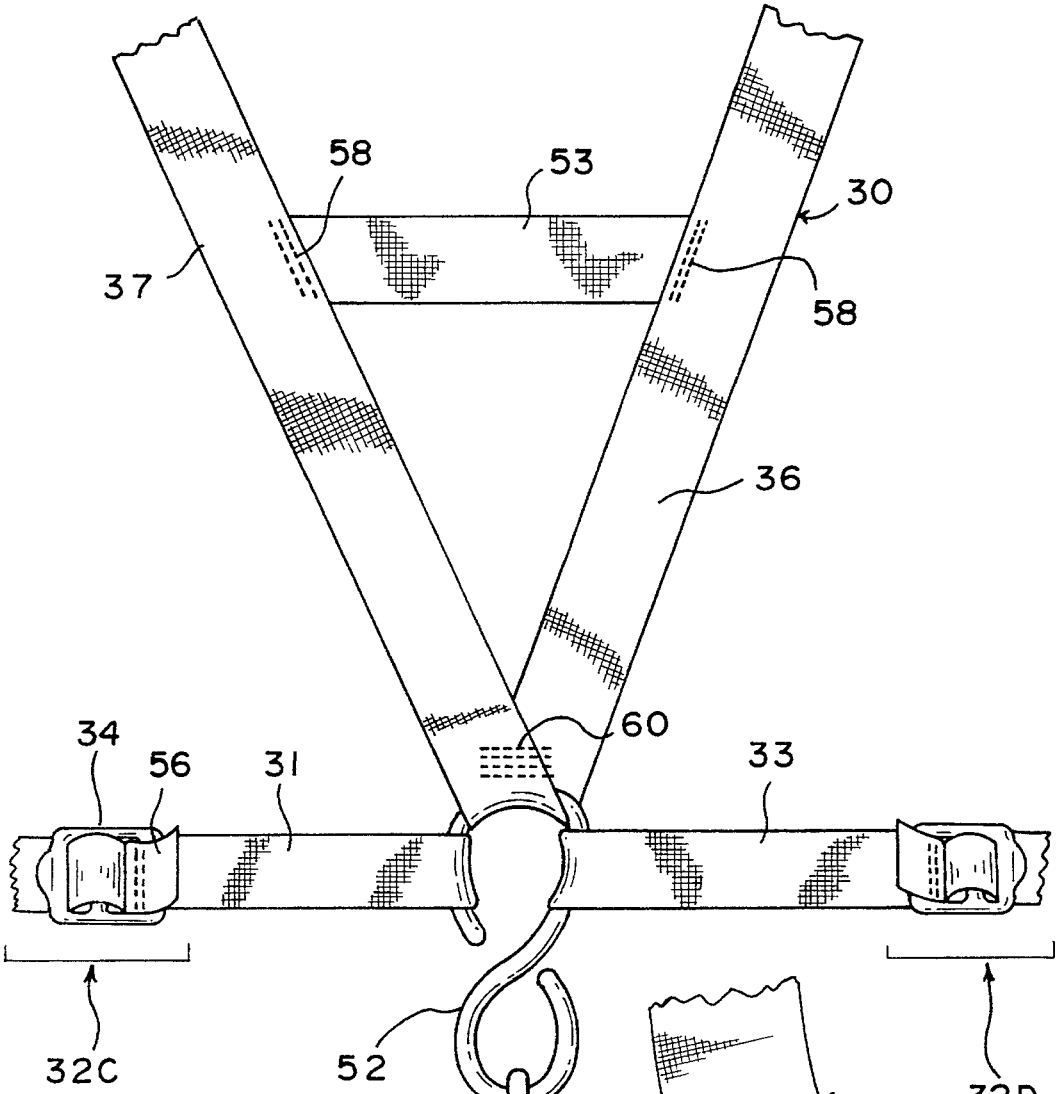
FIG. 5 is a partial rear elevation view enlarged to show the various connections that help in securing the weight supporting body harness on the user.

In the upper third of the weight supporting body harness as seen in FIGS. 1, 2 and 3, the torso engaging webbing assembly 30 is one continuous webbing strap that is affixed to itself at two points, one located in a right front webbing length adjusting system 32A and one located in a left front webbing length adjusting system 32B. These points of webbing attachment are shown at 56. This webbing attachment for the continuous webbing strap of the torso engaging webbing assembly 30 is illustrated in FIGS. 1 and 4 and detailed in FIG. 6. Webbing length adjusting system 32A receives a portion of the torso engaging webbing strap in the form of a right shoulder strap 36 anchored to itself within a right front ladderlock 34. Webbing length adjusting systems 32A–D facilitate easy adjustment of webbing length via one freely moving portion of the torso engaging webbing or waist encircling webbing 31 woven into each ladderlock 34 in the upper portion of each ladderlock 34. In the lower portion of each ladderlock 34, the torso engaging webbing or waist encircling webbing 31 is anchored to itself within ladderlock 34 at point of webbing attachment 56 where the torso engaging webbing or waist encircling webbing 31 is sewn onto itself, as seen in FIGS. 4 and 5.

Figure 6:
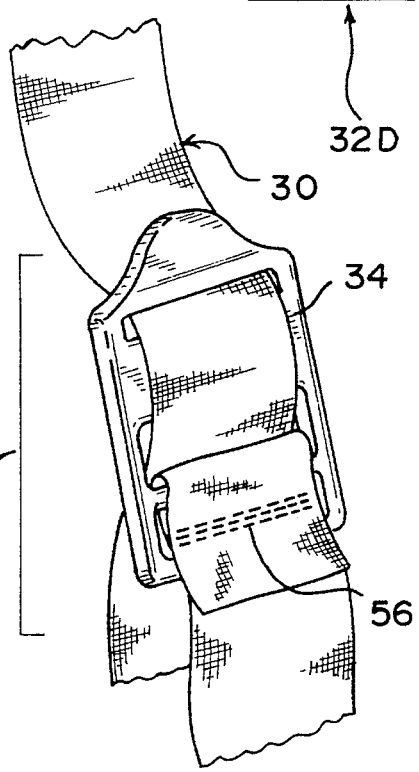
FIG. 6 is an enlarged partial sectional view showing a system for varying the length of the shoulder suspender straps according to the needs of the user.

To better understand the origin, path, and termination of the torso encircling webbing in the upper third of the weight supporting body harness, follow the ensuing description. As an arbitrary point of origin, start at right front ladderlock 34 within webbing length adjusting system 32A for the right suspender strap 36 of the torso engaging webbing assembly generally at 30. In the lower portion of this ladderlock 34 torso engaging webbing 30 is anchored to itself within ladderlock 34 at point of webbing attachment 56 where torso engaging webbing 30 is sewn onto itself as seen in FIG. 6. Torso engaging webbing 30 then wraps one-half time around front hoop 42 as seen in FIG. 4, changes direction, and re-enters ladderlock 34 in the upper portion of ladderlock 34 as seen in FIG. 6. Upon exiting ladderlock 34, torso encircling webbing 30 passes over the right shoulder of the user as right shoulder strap 36 as seen in FIG. 2, down the back of the user FIG. 3, and wraps one-half time around S-hook 52 FIG. 5. Torso encircling webbing 30 is secured to itself at a point of webbing attachment 60 FIG. 5. After wrapping one-half time around S-hook 52, torso encircling webbing 30 climbs the back of the user FIG. 3, passes over the left shoulder of the user as left shoulder strap 37, and enters the upper portion of ladderlock left front 34 within left front webbing length adjusting system 32B. Torso engaging webbing 30 passes through left front ladderlock 34, wraps one-half time around front hoop 42 as seen in FIG. 4, changes direction, and re-enters the lower portion of left front ladderlock 34 within webbing length adjusting system 32B and terminates where it anchors to itself at point of webbing attachment 56. A rear stabilizing webbing 53, as seen in FIG. 3, is situated horizontally and bridges the two diagonal sections of shoulder straps 36 and 37 of torso engaging webbing 30 as detailed in FIGS. 3 and 5. This horizontal piece of rear stabilizing webbing 53 is secured to the right and left rear suspender strap portions 36 and 37, respectively, of the torso engaging webbing assembly 30 at points of webbing attachment 58.

The middle third of the weight supporting body harness 10 consists of left and right individual pieces of waist encircling webbing 31 and 33, respectively, left and right rear webbing length adjusting systems 32C and 32D, front hoop 42, S-hook 52, and waistbelt connector system 36. This is illustrated in FIGS. 1, 2, and 3 and detailed in FIGS. 4 and 5. Each piece of waist encircling webbing 31 or 33 originates in left or right rear webbing length adjusting system 32C or 32D on ladderlock 34 left or right rear as seen in FIG. 5. Each webbing piece 31 or 33 is anchored to itself in the portion of its associated ladderlock 34 nearest S-hook 52. It then wraps one-half time around S-hook 52, changes direction, and re-enters ladderlock 34 in the portion of ladderlock 34 furthest from S-hook 52. Webbing length adjusting systems 32C and 32D are detailed in FIG. 6. After re-entering ladderlock 34, each waist encircling webbing 31 or 33 passes through ladderlock 34, travels along the waistline of the user (FIG. 2) and enters the rectangular portion of a snaphook 38. It then makes a one-half turn around that portion of snaphook 38, changes direction, and is sewn onto itself at point of webbing attachment 54. Left and right waist belt snaphooks 38 are depicted in detail in FIG. 4.

The lower third of the weight supporting body harness consists of a front snaplink 40 which is connected to a front end of a chain of annular rings 48. This is illustrated in FIGS. 1, 2, and 3 and detailed in FIGS. 4 and 5. Chain of annular rings 48 is anchored at its rear end to S-hook 52 as seen in FIG. 5. It hangs between the legs of the user and reattaches to the weight supporting body harness via snaplink 40 which anchors onto front hoop 42. The cooperation of front hoop 42 and snaplink front 40 is detailed in FIG. 4.

In the preferred embodiment of the weight supporting body harness generally at 10, torso engaging webbing 30, waist encircling webbing 31 and 33, and rear stabilizing webbing 53 are nylon or propylene, but in other embodiments they could be made of leather, cotton, or any other material suitable for withstanding the strain posed upon it by a load. In addition, they could be made using various combinations of leather, cotton, or other material. For example, torso engaging webbing assembly 30 could be leather while waist encircling webbing 31 and 33 could be cotton and rear stabilizing webbing 33 could be nylon. Shoulder pads could be added to the right and left side suspender straps 36 and 37, if desired.

In the preferred embodiment, the upper, middle, and lower thirds of the weight supporting body harness intersect at S-hook 52. In other embodiments, a snaphook, hoop, quicklink, or any such securing device or combination of securing devices could be substituted for S-hook 52.

In the preferred embodiment, snaplink 40 serves to anchor chain of annular rings 48 to front hoop 42. In other embodiments, snaplink 40 could be replaced by a quicklink, snaphook, S-hook, or any such securing device or combination of securing devices.

In the preferred embodiment, the middle third of the weight supporting body harness is composed of two pieces of waist encircling webbing 31 and 33. In other embodiments, the middle third of the weight supporting body harness could be comprised of one piece of waist encircling webbing 31 that originates on front hoop 42, passes along the user's waistline, through S-hook 52, continues along the waistline, and anchors to waistbelt connector system 36 that originates on the opposite side of front hoop 42 that waist encircling webbing 31 originated.

The upper third of weight supporting body harness is responsible for supporting the weight attached to the chain 48. This places all load burden on the shoulders of the wearer and none on the hips. The middle portion of the weight supporting body harness bears no load whatsoever, so the spinal column and chord are not in any way endangered. The sole purpose of the middle portion of the weight supporting body harness 10 is to make sure that the position of the weight supporting body harness 10 on the user does not get altered during use. It is analogous to guard rails on the highway. The guard rails are a safety measure that insures the proper location of automobiles on the highway. The middle portion insures proper positioning of the weight supporting body harness 10 on the user in a comfortable and safe manner.

The user experiences a shift in his or her center of gravity during use. This shift is a decrease in the height of the center of gravity. This is beneficial in that no threat of a loss of balance or a toppling-over sensation exists. As described above, devices that allow the user to increase bodyweight resistance at the expense of an increase in the height of the user's center of gravity are highly dangerous. A system that accomplishes the same goal that actually lowers the user's center of gravity is significantly safer to use because a lower center of gravity exponentially decreases the likelihood of falling due to excessive weight borne by a trainer unaccustomed to bearing such weight.

The manner for using the weight supporting body harness 10 of the present invention is readily discernible from FIGS. 1, 2, and 3. The user dons the weight supporting body harness by opening the two snaphooks 38 and removing them from their anchoring position on front hoop 42. The user must also open snaplink 40 and remove it from its anchoring position on front hoop 42. These two steps can be performed in random order.

The user then places his or her arms within the torso engaging webbing assembly 30 of the weight supporting body harness 10 such that the weight supporting body harness rests on his or her shoulders as depicted in FIGS. 1, 2, and 3. Essentially this is done by holding the weight supporting body harness in such a manner that the user can put his or her head in between the two shoulder engaging straps 36 and 37 of the torso engaging webbing assembly 30 that comprise the upper third of the weight supporting body harness. The weight supporting body harness is positioned correctly on the shoulders when both front hoop 42 and S-hook 52 are in line with the user's waistline. If they are not so situated then the user should adjust the lengths of the shoulder straps 36 and 37 of the torso encircling webbing assembly 30 by using the webbing length adjusting systems 32A and 32B as seen in FIG. 4. This is accomplished by moving ladderlocks 34 along the freely sliding portions of the shoulder straps 36 and 37 which are connected to ladderlock 34 in the upper portion of ladderlock 34 as seen in FIG. 6.

When the weight supporting body harness 10 is correctly positioned on the shoulders of the wearer, snaphooks 38 can be re-anchored to front hoop 42. The length of waist encircling webbings 31 and 33 that run along the waistline of the user in the middle third of the weight supporting body harness should be adjusted such that when snaphooks 38 are anchored to front hoop 42, the user experiences three to five centimeters (one to two inches) of slack along his or her waistline. All of the above steps should be completed prior to loading any weightlifting weights 50 onto the chain 48 of the weight supporting body harness 10.

The weight supporting body harness 10 is compatible with both standard and olympic type weights 50. For use with standard type weights, snaplink 40 must be opened and removed from chain of annular rings 48. Then chain of annular rings 48 can be passed through the hole in the center of weightlifting weight 50 and refastened to snaplink 40. Once snaplink 40 is anchored to front hoop 42, the weight supporting body harness 10 is ready for use. For use with olympic type weights 50, snaplink 40 is merely passed through the hole in the center of weightlifting weight 50 and subsequently anchored to front hoop 42. The length of chain of annular rings 48 can be varied by removing snaplink 40 from the end of chain of annular rings 48 and refastening it on any individual annular ring that comprises chain of annular rings 48. This feature serves to adjust the positioning of weightlifting weight 50 according to the desire of the user. Weightlifting weight 50 properly rests between the legs of the person wearing the weight supporting body harness, as depicted in FIG. 1. More than one weightlifting weight 50 can be used.

From the description above, a number of advantages of the weight supporting body harness 10 in accordance with the present invention become apparent. A weight trainer can use more than just his or her own bodyweight when performing pull-ups, chin-ups, or dips, thus eliminating the need for increasing the number of repetitions or sets performed in response to muscle growth. A weight trainer using the present invention will support the weight with his or her shoulders without increasing the height of the trainer's center of gravity, but instead with lowering of their center of gravity, thus avoiding the possibility of endangering the trainer or nearby trainers if he or she should experience a loss of balance and/or a toppling-over sensation. A weight trainer can support this additional weight in a safe manner without the possibility of endangering his or her spinal column and chord as a result of having weight suspended by the hips, thus avoiding the risk of suffering a slipped disc or a pinched spinal nerve. A weight trainer can support the desired amount of additional weight with a weight supporting body harness 10 that is compatible with the conventional standard or olympic size weight found in all gyms, thus eliminating the need for the unnecessary purchase of weight specific to the weight supporting body harness 10 and otherwise useless. A weight trainer can use the weight supporting body harness 10 without making multiple adjustments of the weight supporting body harness 10 when sharing it with a partner, thus allowing the trainer to recuperate in between sets instead of interrupting the flow of the workout by spending time in between sets making numerous adjustments to allow the weight supporting body harness 10 to fit different users. A weight trainer can weight train using additional weights without the aid of a supporting rack or structure or any assistance from a partner for donning the weight supporting body harness 10, thus allowing the trainer to train alone without limiting the space available for other exercise machinery. A weight trainer can perform the desired weight training with a weight supporting body harness 10 that is portable, easy to use, convenient, compact, and within the budget of individual trainers rather than the budgets of individual gyms, thus allowing the trainer to set the adjustments to his or her own dimensions and carry it with him or her when traveling.

While a preferred embodiment of a weight supporting body harness in accordance with the present invention has been set forth fully and completely hereinabove, it will be apparent to one of skill in the are that a number of changes in, for example, the thickness of the materials used, the amounts of weights used and the like could be made without departing from the true spirit and scope of the present invention which is accordingly to be limited only by the following claims.

What is claimed is:

1. A weight supporting body harness adapted to be positioned on the body of a user to facilitate the attachment of additional weight to the user, said weight supporting body harness comprising:

a continuous, nonelastic torso engaging webbing assembly including left and right suspending portions with left and right front ends adapted to be positioned about the torso of a user with said suspending portions engageable with a user's shoulders;

a waist encircling webbing assembly including left and right side waist straps each having a forward end and a rear portion adapted to be positioned about the waist of a user;

means to adjust a length of said torso engaging webbing assembly;

means to adjust a length of said waist encircling webbing assembly;

a front hoop supported by said left and right front ends of said continuous torso engaging webbing assembly, said front hoop adapted to be positioned at a first portion of a user'waist;

means to connect said forward ends of said left and right side waist straps to said front hoop;

a rear hook connected no said continuous torso engaging webbing assembly generally at a midlength thereof, said rear hook adapted to be positioned at a rear portion of a user's waist;

means to connect said rear portions of said left and right side waist straps to said rear hook; and a flexible weight suspending means having a front end releasably secured to said front hoop and a back end releasably secured to said rear hook said weight suspending means for use to support weight between the legs of a user of said weight supporting body harness.

2. The weight supporting body harness of claim 1 wherein said forward end of each said waist strap has a snaphook, said snaphooks being releasably engaged with said front hoop.

3. The weight supporting body harness of claim 1 wherein said rear hook connected to said continuous web of said torso engaging webbing assembly is a generally S-shaped hook.

4. The weight supporting body harness of claim 1 further including a rear stabilizing webbing connected to said left and right suspender straps above said rear hook.

* * * * *